US007143848B2

(12) United States Patent
Armell

(10) Patent No.: US 7,143,848 B2
(45) Date of Patent: Dec. 5, 2006

(54) DOWNHOLE TOOL

(76) Inventor: Richard A. Armell, Nuestro Casa, Kirkton, St. Cyrus, Montrose, Angus, Scotland (GB) DD10 0BW ( * ) Notice: Subject to any disclaimer, the term of this patent is extended or adjusted under 35 U.S.C. 154(b) by 223 days.

(21) Appl. No.: 10/848,734

(22) Filed: May 19, 2004

(65) Prior Publication Data

US 2004/0244967 A1 Dec. 9, 2004

(30) Foreign Application Priority Data

Jun. 5, 2003 (GB) ..... 0312899.8
Apr. 6, 2004 (GB) ..... 0407756.6

(51) Int. Cl.
*E21B 17/10* (2006.01)

(52) U.S. Cl. ..... 175/325.1; 175/76; 166/241.1

(58) Field of Classification Search ..... 175/263, 175/267, 76, 325.1; 166/174, 241, 241.1
See application file for complete search history.

(56) References Cited

U.S. PATENT DOCUMENTS 2,049,450 A * 8/1936 Johnson ..... 175/271
2,679,383 A * 5/1954 Garrison ..... 175/269
2,756,968 A * 7/1956 Emanuel et al. ..... 175/269
3,419,077 A * 12/1968 Sanford ..... 166/55.8
3,530,675 A * 9/1970 Turzillo ..... 405/229
3,552,507 A * 1/1971 Brown ..... 175/258
4,693,328 A * 9/1987 Furse et al. ..... 175/275
4,843,896 A * 7/1989 Napeloni et al. ..... 73/866.5
4,889,197 A * 12/1989 Boe ..... 175/267
5,060,738 A * 10/1991 Pittard et al. ..... 175/267
5,358,040 A * 10/1994 Kinley et al. ..... 166/241.3
5,582,260 A * 12/1996 Murer et al. ..... 175/76
6,679,328 B1 * 1/2004 Davis et al. ..... 166/298
2004/0112587 A1 * 6/2004 Van Drentham Susman et al. ..... 166/173
2004/0195007 A1 * 10/2004 Eppink ..... 175/61

* cited by examiner

*Primary Examiner*—David Bagnell
*Assistant Examiner*—Daniel P Stephenson
(74) *Attorney, Agent, or Firm*—William Nitkin

(57) ABSTRACT

An expandable centralizer is disclosed having a body having a first portion of circular cross-section and a second portion of polyhedral cross-section. Centralizing members are arranged on the faces of the second portion which, in a first position, limit the diameter of the tool so that it can pass through small openings in a wellbore. The centralizing members can then be moved hydraulically across the faces to extend and provide support for the expandable downhole tool in larger openings within the wellbore.

6 Claims, 4 Drawing Sheets

DOWNHOLE TOOL

This application claims priority and benefit of a United Kingdom patent application entitled Downhole Tool, patent application no. 0407756.6 filed Apr. 6, 2004, now pending, claiming priority and benefit of United Kingdom provisional application entitled Downhole Tool, no. 0312899.8 filed Jun. 5, 2003, now pending.

BACKGROUND OF THE INVENTION

1. Field of the Invention

The present invention relates to centralizers used to center tools in a tubular or wellbore downhole and more particularly relates to an expandable centralizer which can center a tool in an opening larger in diameter than a diameter through which the unexpanded centralizer can freely pass.

2. History of the Prior Art

When drilling or working on wellbores for use, for example, in oil and gas exploration, it is desirable to be able to increase the diameter of the wellbore at a location within the well. This is typically done below a section of casing and thus a tool capable of being passed through the casing, which has a first diameter, and expanding to cut or mill out a bore having a diameter greater than the first diameter must be used. Such tools are referred to as underreamers.

Underreaming tools commonly have one or more pairs of cutting blades which are movable from a retracted position to an extended position. The tool is maintained in the retracted position so that it may pass through the casing. It is then moved to the extended position and held there by fluid pressure created in the drill string. A disadvantage of these tools is that the two blade arrangement provides 4 point contact on the walls of the wellbore which does not centralize the tool when the wellbore is inclined or horizontal.

Centralizers are known for centering tools in a wellbore. The first type typically comprise a cylindrical body sized to have a diameter approximately equal to the diameter of the wellbore at the location where the tool needs to be centered. Unfortunately these centralizers cannot pass through openings smaller than the diameter of the wellbore at the location where the tool needs to be centered and therefore cannot be used to center underreamers.

A second class of centralizers has a cylindrical body having longitudinally arranged spring bows disposed circumferentially around the body. These centralizers can pass through openings as small as the diameter of the body and then expand, by virtue of the bows, to centralize themselves and a drill string in wellbores of larger diameters. However, due to the weight of the drill string, these centralizers tend to "drop" to the low side of an inclined or horizontal well and thus lose their centering ability in these environments.

SUMMARY OF THE INVENTION

It is an object of the present invention to provide a centralizer for centering a tool in an opening larger in diameter than the diameter of an opening through which the centralizer can freely pass.

It is a further object of the present invention to provide a centralizer which can center a tool on a drill string in wellbores of any inclination.

It is a yet further object of the present invention to provide an expandable centralizer which can centralize a tool through a wellbore of varying diameter.

According to a first aspect of the present invention there is provided an expandable centralizer for centering a tool in a wellbore having an opening larger in diameter than the diameter of an opening through which the centralizer can freely pass, the centralizer comprising a body connectable in a work string, said body having a bore running axially therethrough, said body including a first portion being substantially cylindrical with a substantially circular cross-section of a first diameter and a second portion being polyhedral in cross-section to provide a plurality of faces parallel to said bore; a plurality of centralizing members, each centralizing member being located on a said face; and actuating means, said actuating means, on actuation, moving said centralizing members from a first position within the first diameter to a second position wherein portions of said centralizing members are located outside and beyond the first diameter.

Preferably the second position is variable depending on the amount of movement of the actuating means and such second position is preferably the diameter of the larger opening.

Thus the centralizer is expandable so that the centralizing members can remain within the first diameter for the centralizer to pass through a small opening and can then be extended to contact a bore of a larger diameter and hence centralize the tool.

Although the centralizer can operate with two centralizing members, it is more preferable for there to be three or more centralizing members. It is still more preferable that there be an odd number of centralizing members. In a preferred embodiment there are three centralizing members. This provides a simple mechanical design.

Preferably the faces are identical and arranged equidistantly around the body. Advantageously there are three faces, providing a triangular cross-section, with a centralizing member arranged on each face.

Preferably each centralizing member is pivoted against a face. Thus on actuation, each centralizing member swings across the face and extends from it. Preferably also a spring is located at each pivot such that each centralizing member is returned to the first position from the second position on cessation of the actuation.

Preferably the actuating means is a piston, the piston having a leading end arranged to contact an operating face of each centralizing member, on actuation thereof. Preferably the piston is hydraulically actuated. More preferably the piston operates by differential fluid pressure created in the work string.

The centralizer can include one or more intensifiers, each intensifier comprises a first face perpendicular to the bore having a surface area greater than an operating surface area of the piston. Each intensifier can abut a first face of a neighboring intensifier to provide a cascade. Preferably one intensifier is arranged to abut the operating surface area of the piston. In this way the centralizer can be operated in a work string having a low fluid pressure at the centralizer as would occur if the centralizer is located below a motor on the work string.

Preferably the second portion is arranged on a cylindrical core of the body. In this way the first and second portions can rotate independently of each other. Thus, in use, the first portion can rotate with the work string while the centralizing members remain stationary in the wellbore.

BRIEF DESCRIPTION OF THE DRAWINGS

FIG. 3(*b*) illustrates a perspective cross-sectional view through the expandable centralizer of FIG. 1 with the centralizing members in the second position.

FIG. 4(*b*) illustrates a side elevational view of the expandable centralizer of FIG. 1 in a second position.

DESCRIPTION OF THE PREFERRED EMBODIMENT(S)

Figure 1:
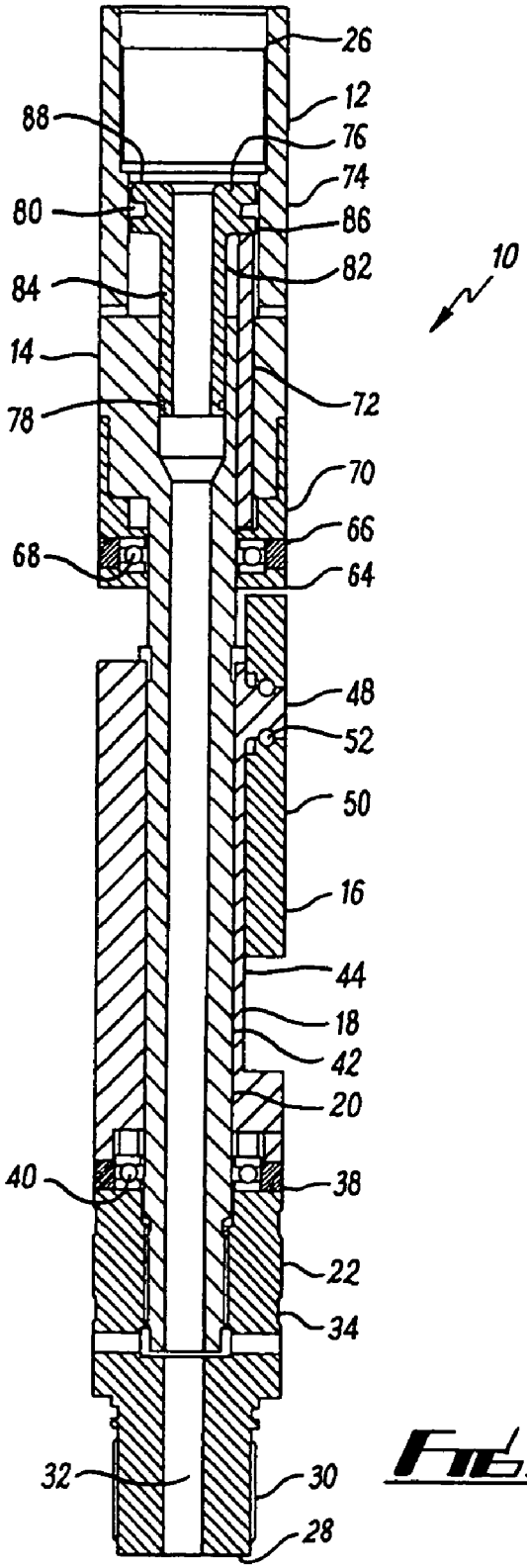
FIG. 1 illustrates a cross-sectional view an expandable centralizer according to the present invention.

Referring initially to FIG. 1, there is illustrated an expandable centralizer generally indicated by reference number 10 in accordance with an embodiment of the present invention. Centralizer 10 comprises a body 12 having a first portion 14 which is substantially cylindrical and defines the diameter of centralizer 10. A further portion 16 comprises a sleeve 18 mounted over a narrow cylindrical portion 20. Mounted below second portion 16 is a third portion 22 which is also substantially cylindrical. At an upper end 24 of centralizer 10 is located a connector 26 for connecting centralizer 10 into a drill string (not shown). At a lower end 28 of centralizer 10 is located a threaded portion 30 for connecting centralizer 10 to a lower portion of a drill string (not shown). It will be appreciated that connectors 26 and 28 can be used to connect centralizer 10 to a tool within a drill string which requires it to be centralized in the wellbore.

Figure 2:
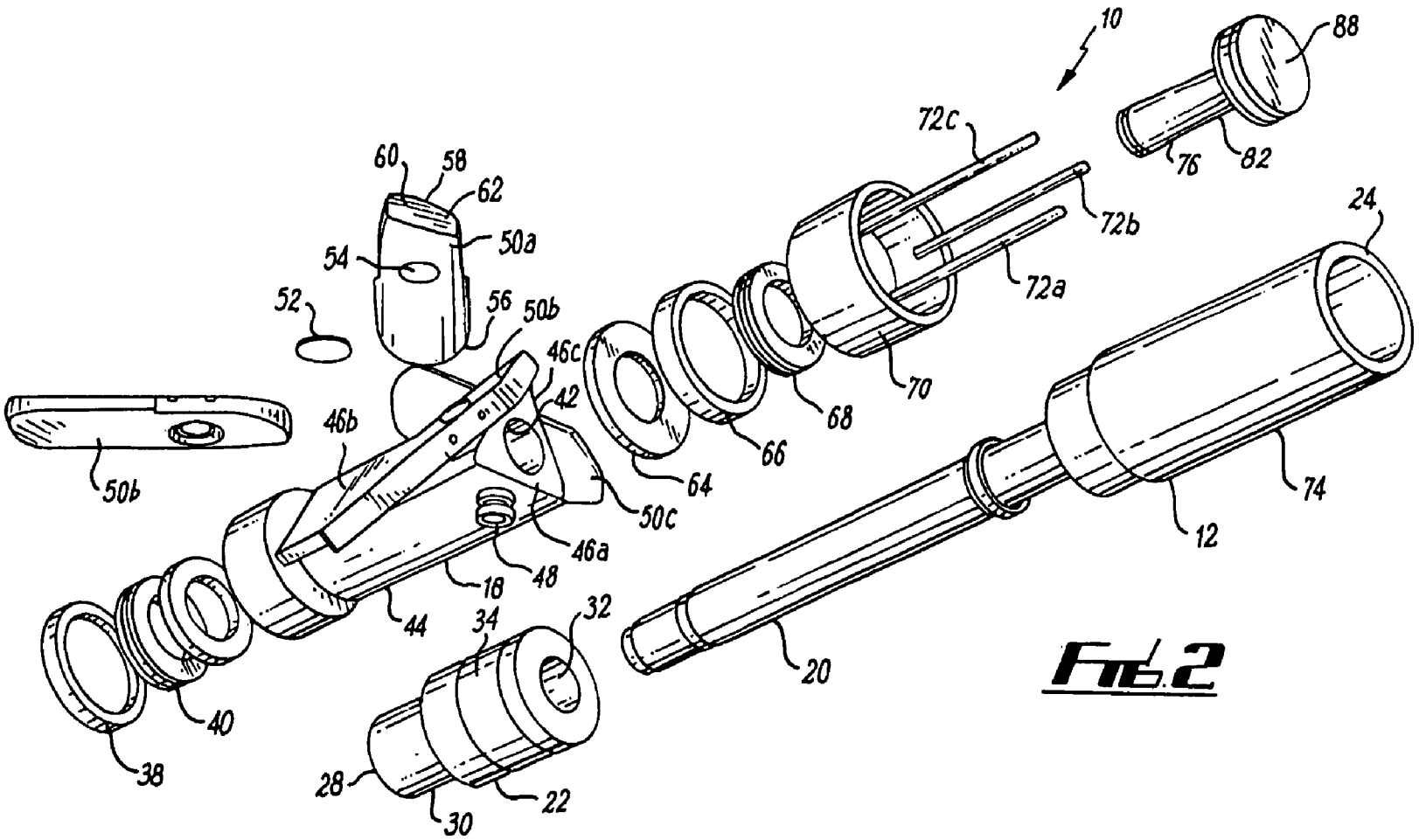
FIG. 2 illustrates an exploded perspective view of the expandable centralizer of FIG. 1.

The remaining components of centralizer 10 are best seen when FIG. 1 is viewed in conjunction with FIG. 2. FIG. 2 illustrates an exploded view of centralizer 10 of FIG. 1 with like parts being given the same reference number to aid clarity. Centralizer 10 has an axial bore 32 passing through a center axis from the upper end 24 to the lower end 28 of centralizer 10. Arranged from lower end 28 there is located the connector 30 and above this rests a sub 34 located around cylinder 20. Allen set screws connect sub 34 to cylinder 20 so that they can rotate together. Above sub 34 is located a nylon spacer 38 protecting thrust ball bearings 40. Ball Bearings 40 provide for rotation of sleeve 18 on sub 34. Sleeve 18 has an inner cylindrical surface 42. Inner surface 42 provides a smooth sliding relationship with narrow cylinder 20.

Outer surface 44 of sleeve 18 comprises a substantially triangular arrangement of three surfaces 46 *a, b*, and *c*, providing an equilateral triangle on outer surface 44 of sleeve 18, Each face 46 *a, b, c* includes a pivot 48 on which a centralizing member 50 *a, b, c* is pivotally positioned. A spring 52 is located on pivot 48 to bias the centralizing members 50 to a longitudinal position where they rest upon each face 46.

Each centralizing member 50 comprises a paddle having an aperture 54 for connection to pivot 48, a rounded edge 56 and an upper actuating edge 58. Edge 58 comprises two portions, a short planar portion 60 and a sloping portion 62. Centralizing members 50 can be made of any suitable material although they are preferably made of stainless steel. Further they can be of any shape which allows them, once arranged in a longitudinal position on face 46, to reside within the diameter of upper portion 14. Upper edge 58 of each centralizing member 50 rests above face 46 so that they can be acted upon by an actuating surface 64.

Actuating surface 64 is a lower face of upper portion 14. Face 64 is arranged on a further nylon spacer 66 with equivalent thrust ball bearings 68. Face 64 can rotate independently of sleeve 18 and centralizing members 50. Above spacer 66 is arranged a cam 70 which is acted upon by three cam pins 72 *a, b, c*. In the embodiments shown, cam pins 72 are attached to cam 70 for ease of operation. Cam pins 72 are protected by an outer sleeve 74 arranged around upper portion 14 of centralizer 10.

In inner bore 32 above cam pins 72 is located a piston 76. Piston 76 includes two pairs of seals 78 and 80 to prevent fluid within bore 32 leaking to other portions of the centralizer on the outer surface 82 of piston 76. Piston 76 acts as an intensifier by having a narrow portion 84 and a broader portion 86. In this way an upper surface 88 is provided on the broader portion 86 with a large surface area on which fluid within the bore can act to operate piston 76. It will be appreciated that further pistons of this design can be mounted above piston 76, each with decreasing narrower portions 84 and substantially greater surface areas 88 so that fluid pressure on the upper surfaces 88 increases the effective pressure on each piston in turn.

Figure 3A:
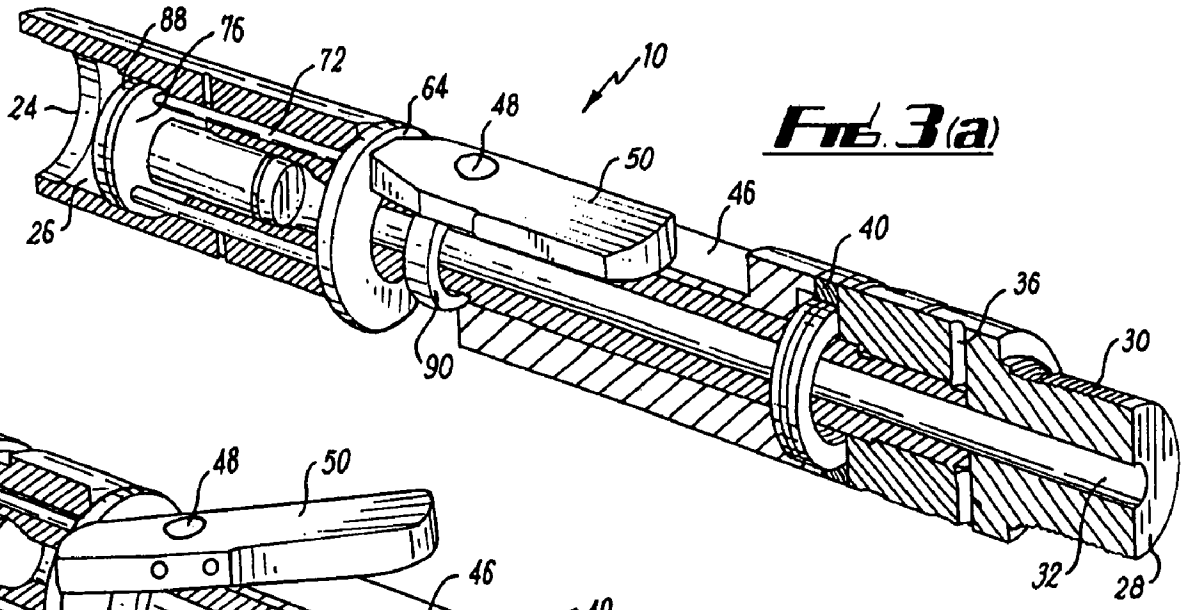
FIG. 3(*a*) illustrates a perspective cross-sectional view through the expandable centralizer of FIG. 1 with the centralizing members in the first position.
Figure 3B:
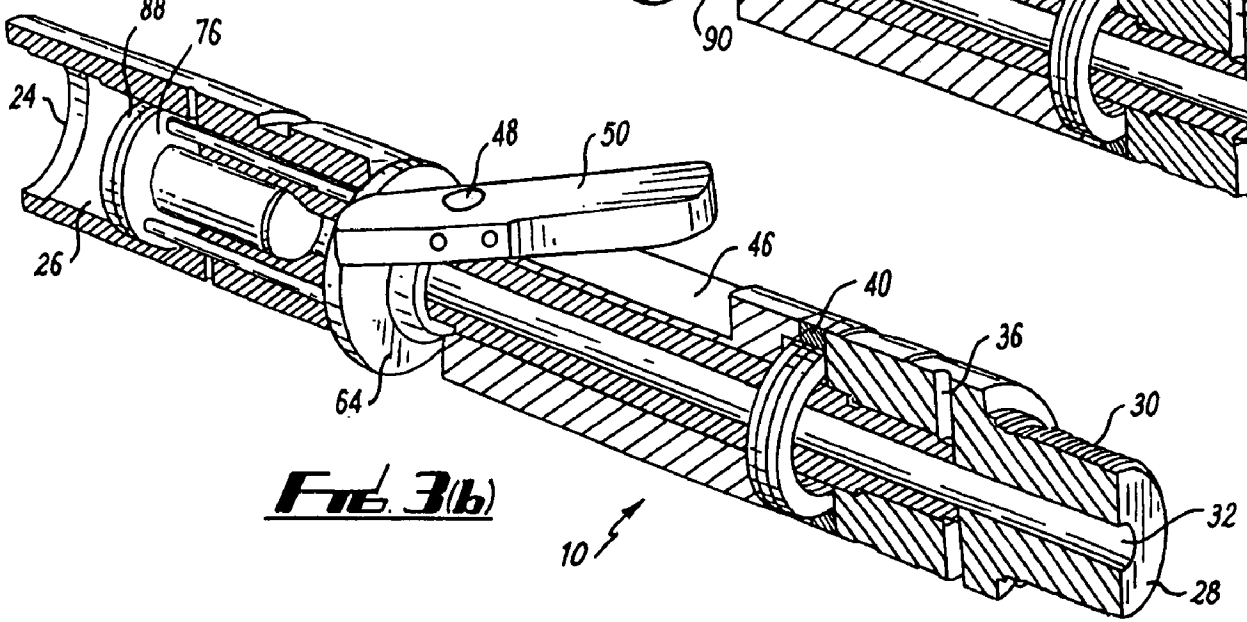
Figure 4A:
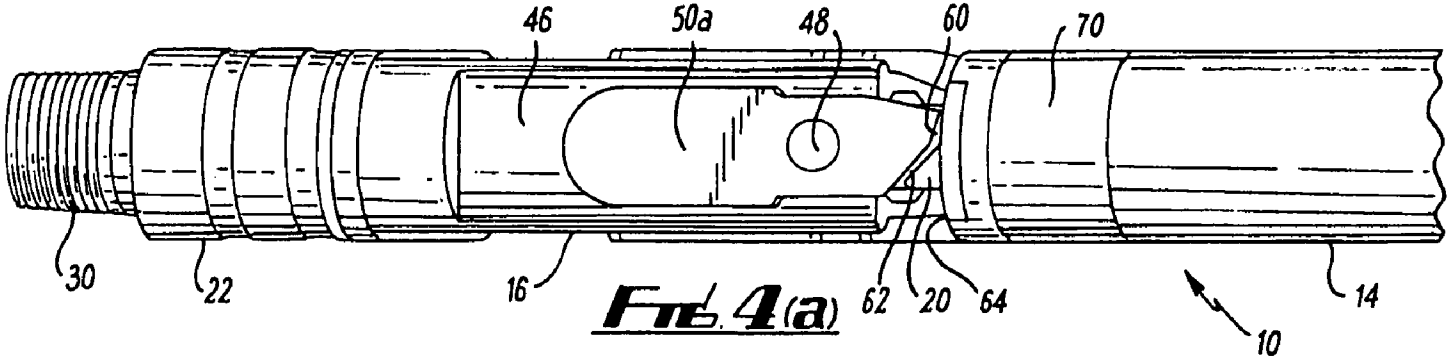
FIG. 4(*a*) illustrates a side elevational view of the expandable centralizer of FIG. 1 in a first position.
Figure 4B:
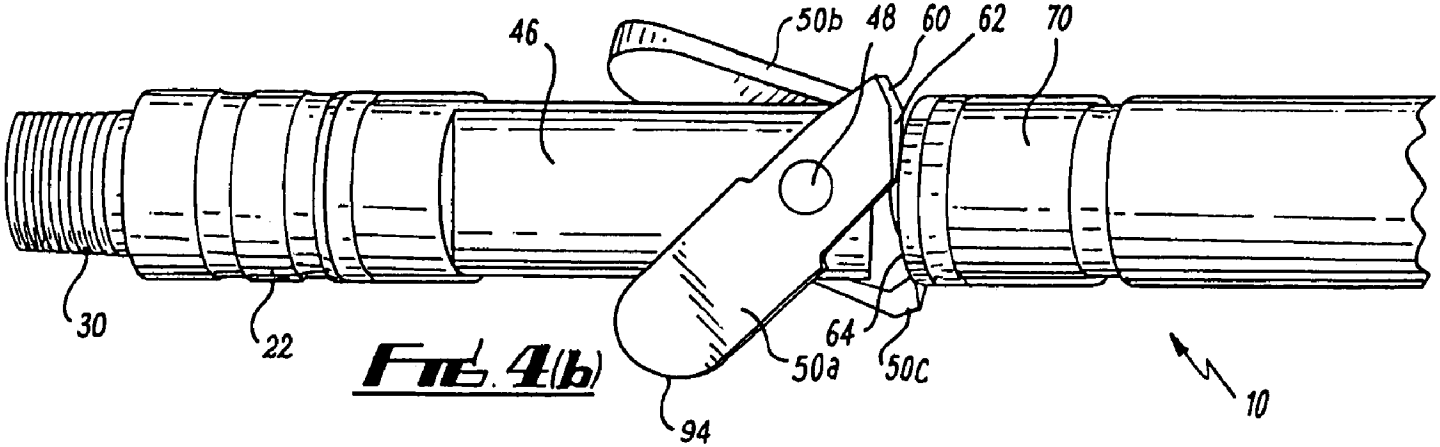

Reference is now made to FIGS. 3(*a*) and 3(*b*) of the drawings which illustrate centralizer 10, respectively, in a first position and in a second position operating position. Like parts to those of FIGS. 1 and 2 have been given the same reference numeral to aid clarity. In use, sleeve 18 is located on cylinder 20 and centralizing members 50 located on the pivots 48. Cam 70 rests between sleeve 18 and body 12 with cam pins 72 inside body 12 resting against piston 76. Threaded connector 30 is connected to a drill string and preferably to a tool, for example an underreamer in the drill string. Upper connector 26 is connected to the remaining drill string which can include a motor.

When a low pressure is maintained through bore 32 in the wellbore, piston 76 is not actuated. Cam 70 rests against upper portion 14. In this position each centralizing member 50 is arranged parallel with bore 32 and remains substantially on a respective face 46. Upper surface 60 of centralizing member 50 rests against actuating surface 64 of the above portion 14. In this position the centralizer can be run through a wellbore casing which has a diameter equal to, or greater than, the diameter of upper portion 14.

When the underreamer has reached a position for operation within the wellbore, the underreamer can be centralized by increasing fluid pressure through bore 32. An increase in fluid pressure provides a pressure differential across surface 88 of piston 76. Piston 76 is then forced downwards with cam pins 72 driving cam 70 in a downward direction such that the actuating surface 64 contacts surface 58 of each centralizing member 50. As the actuating surface 64 is moving towards the lower end 28 of centralizer 10, surface 58 will run on surface 64 such that the contact with surface 58 will move from the small portion 60 to the larger surface 62 of centralizing member 50. As this movement occurs, centralizing member 50 is forced to swing on pivot 48 so that it moves across face 46 and extends from sleeve 18. A stop 90 limits the radial extension of each centralizing member 50 by abutting to surface 64. All centralizing members 50 *a, b, c* will pivot on their pivot points to move simultaneously as piston 76 moves. It will be appreciated that outer edge 94 of each centralizing member 50 will also limit the radial extent of the centralizer as it abuts an inner surface of a casing or wellbore. In this way centralizer 10 can be used in a wellbore casing of a variable diameter as each centralizing member 50 can dynamically move in response to pressure applied at surface 94. The pressure upon piston 76 ensures that centralizing members 50 are always in their most radially extended position as required.

When work is finished in the wellbore, pressure within bore 32 is dropped and as a result piston 76 is relaxed. Springs 52 move centralizing members 50 back to their longitudinal positions on each of the faces 46 of sleeve 18. Centralizer 10 can then be retracted with the underreamer back through a small diameter opening.

The principal advantage of the present invention is that it provides a centralizer for centering a tool in an opening of larger diameter than the diameter of an opening through which the unextended centralizer can pass freely.

A further advantage of the present invention is that it provides a centralizer which can center a tool on a drill string in wells of any inclination because the pressure applied on each of the surfaces 94 of centralizing members 50 is uniform and the centralizing members 59 are therefore not inclined to drop to a lower side of the wellbore.

It is a yet further advantage of the present invention in providing a centralizer which can centralize a tool in varying diameters of a wellbore.

Although the present invention has been described with reference to particular embodiments, it will be apparent to those skilled in the art that variations and modifications can be substituted therefor without departing from the principles and spirit of the invention. For instance, although only three centralizing members 50 are shown in the embodiment described, it will be appreciated that any odd number of centralizing members 50 can be used. Additionally, although only a single piston 76 is shown, identical pistons having greater surface areas 88 can be stacked up on piston 76 to provide one or more intensifiers.

I claim:

1. An expandable centralizer for centering a tool in a wellbore having an opening larger in diameter than the diameter of an opening through which the expandable centralizer can freely pass the expandable centralizer comprising:

a body connectable in a workstring, said body having a bore defined therein running axially therethrough, said body including:

a first portion being substantially cylindrical in shape and having a substantially circular cross-section of a first diameter;

a second portion being polyhedral in cross-section and having a plurality of faces disposed parallel to said bore;

a plurality of centralizing members, one of said centralizing members being located, respectively, on one of said faces:

actuating means for moving said centralizing members from a first position within said first diameter to a second position wherein portions of said centralizing members are located outside said first diameter;

wherein said second position is variable depending on said actuating means;

wherein there are at least three centralizing members;

wherein said faces are identical and are arranged equidistantly around said body;

wherein there are three faces, wherein said second portion has a triangular cross-section, and wherein each face has an associated centralizing member arranged thereon;

wherein each centralizing member includes a pivot point and each centralizing member is pivoted at said pivot point against its associated face; and further including a spring located at each of said pivot points such that each member is returned to said first position from said second position on cessation of operation of said actuating means.

2. The expandable centralizer of claim 1 wherein said actuating means is a piston, said piston having a leading end arranged for contacting a portion of each centralizing member, on actuation of said piston.

3. The expandable centralizer of claim 2 wherein said piston is hydraulically actuated.

4. The expandable centralizer of claim 3 wherein differential fluid pressure created in said workstring operates said piston.

5. The expandable centralizer of claim 4 further including at least one intensifier, each intensifier having a first face disposed perpendicular to said bore, said first face having a surface area greater than said operating surface area of said piston.

6. An expandable centralizer for centering a tool in a wellbore having an opening larger in diameter than the diameter of an opening through which the expandable centralizer can freely pass, the expandable centralizer comprising:

a body connectable in a workstring, said body having a bore defined therein running axially therethrough, said body including:

a first portion being substantially cylindrical in shape and having a substantially circular cross-section of a first diameter;

a second portion being polyhedral in cross-section and having a plurality of faces disposed parallel to said bore;

a plurality of centralizing members, one of said centralizing members being located, respectively, on one of said faces;

actuating means for moving said centralizing members from a first position within said first diameter to a second position wherein portions of said centralizing members are located outside said first diameter; and wherein said second portion of said body is arranged on a cylindrical core for allowing said first and second portions to rotate independently of each other.

* * * * *